US010629977B2

(12) United States Patent
Motoi

(10) Patent No.: US 10,629,977 B2
(45) Date of Patent: Apr. 21, 2020

(54) FILTER CIRCUIT AND FREQUENCY SWITCHING METHOD

(71) Applicant: NEC Corporation, Minato-ku, Tokyo (JP)

(72) Inventor: Keiichi Motoi, Tokyo (JP)

(73) Assignee: NEC CORPORATION, Tokyo (JP)

( * ) Notice: Subject to any disclaimer, the term of this patent is extended or adjusted under 35 U.S.C. 154(b) by 3 days.

(21) Appl. No.: 16/068,153

(22) PCT Filed: Jan. 16, 2017

(86) PCT No.: PCT/JP2017/001148
§ 371 (c)(1),
(2) Date: Jul. 5, 2018

(87) PCT Pub. No.: WO2017/126452
PCT Pub. Date: Jul. 27, 2017

(65) Prior Publication Data

US 2019/0020092 A1 Jan. 17, 2019

(30) Foreign Application Priority Data

Jan. 19, 2016 (JP) ..... 2016-007911

(51) Int. Cl.

| | |
|---|---|
| ***H01P 1/10*** | (2006.01) |
| ***H01P 5/10*** | (2006.01) |
| ***H01P 1/20*** | (2006.01) |
| ***H01P 1/203*** | (2006.01) |
| ***H01P 5/16*** | (2006.01) |

(52) U.S. Cl.
CPC ..... *H01P 5/10* (2013.01); *H01P 1/20* (2013.01); *H01P 1/20381* (2013.01); *H01P 5/16* (2013.01)

(58) Field of Classification Search
CPC ..... H01P 1/10; H01P 5/10; H01P 1/20; H03H 7/01; H03H 7/42
(Continued)

(56) References Cited

U.S. PATENT DOCUMENTS 6,404,304 B1 6/2002 Kwon et al.
7,301,419 B2 * 11/2007 Mizuno ..... H01P 1/15 333/101
(Continued)

FOREIGN PATENT DOCUMENTS

JP 2001119257 A 4/2001
KR 1020010036289 A 5/2001
(Continued)

OTHER PUBLICATIONS

Zhou, L.-H., et al., "Tunable filtering balun with enhanced stopband rejection", Electronics Letters, vol. 48, No. 14. 2 pages, Jul. 2012.
(Continued)

*Primary Examiner* — Dean O Takaoka

(57) ABSTRACT

The objective of the present invention is to provide a filter circuit by which radio wave interference can be avoided through a simple configuration and a frequency band can be effectively used. In order to achieve the objective, the filter circuit according to the present invention is provided with: a first transmission line and a third transmission line each having a predetermined electrical length; a second transmission line opposed to the first transmission line; an input terminal connected to the first transmission line; a fourth transmission line opposed to the third transmission line; a first output terminal and a second output terminal each connected to the fourth transmission line; a first open end connected to the second transmission line; a second open end connected to the third transmission line; a fifth transmission line connected to the second transmission line; a sixth transmission line opposed to the fifth transmission line; a first switch that connects or opens between the fifth transmission line and the ground; and a second switch that connects or opens between the sixth transmission line and the ground. The electrical length of a transmission line composed of the first open end, the second transmission line, and the fifth transmission line, and the electrical length of a transmission line composed of the second open end, the third
(Continued)

transmission line, and the sixth transmission line are each three quarters of a second wavelength corresponding to a second frequency which is higher than a first frequency.

6 Claims, 12 Drawing Sheets

(58) Field of Classification Search
USPC ..... 333/101, 185, 25
See application file for complete search history.

(56) References Cited

U.S. PATENT DOCUMENTS

| | | | | |
|---|---|---|---|---|
| 7,541,888 | B2 * | 6/2009 | Wu | H01P 1/203 333/204 |
| 8,766,739 | B2 | 7/2014 | Chen et al. | |
| 10,381,701 | B2 * | 8/2019 | Motoi | H01P 1/20327 |
| 2009/0115555 | A1 | 5/2009 | Kim et al. | |

FOREIGN PATENT DOCUMENTS

| | | | |
|---|---|---|---|
| KR | 1020090044796 | A | 5/2009 |
| WO | 2016167190 | A1 | 10/2016 |

OTHER PUBLICATIONS

Yeung, L., et al., "A Dual-Band Coupled-Line Balun Filter", IEEE Transactions on Microwave Theory and Techniques, vol. 55, No. 11, pp. 2406-2411, Nov. 2007.

International Search Report, dated Mar. 28, 2017 from the International Bureau in counterpart International application No. PCT/JP2017/001148.

Konishi, Y., et al., "Practical Microwaves Technical Courses: Theory and Practice", 2001, vol. 1, pp. 123-124.

* cited by examiner

FILTER CIRCUIT AND FREQUENCY SWITCHING METHOD

This application is a National Stage Entry of PCT/JP2017/001148 filed on Jan. 16, 2017, which claims priority from Japanese Patent Application 2016-007911 filed on Jan. 19, 2016, the contents of all of which are incorporated herein by reference, in their entirety.

TECHNICAL FIELD

The present invention relates to a filter circuit and a frequency switching method.

BACKGROUND ART

Recently, with a rapid increase in mobile traffic, frequency bands used in a mobile network are increasing. Therefore, for a filter circuit mounted on a communication device, a function of selecting and suppressing a plurality of signals having frequencies different from each other is demanded. Further, in order to improve interference resistance performance, various types of circuits such as a low noise amplifier (LNA) desirably have a differential configuration, and a balun (balanced-to-unbalanced transformation) circuit may be disposed in a subsequent stage of a bandpass filter. It is known that a bandpass filter circuit and a balun circuit may be configured as a balun bandpass filter circuit including functions of both circuits, and similarly to a filter circuit, the balun bandpass filter circuit also needs to respond to a plurality of frequency bands.

As a balun bandpass filter circuit that responds to a plurality of frequency bands, a balun bandpass filter circuit in which a transmission line such as a micro-strip line is configured on a planar circuit is known. PTL 1 and NPL 1, for example, describe a balun bandpass filter circuit including a split-ring resonator and describe that a resonance frequency may be changed by a variable capacitance loaded on the split-ring resonator. Further, NPL 1 discloses a dual-band balun bandpass filter circuit, having two frequencies as a passband, including a micro-strip coupling line.

PTL 1, NPL 1, and NPL 2 describe a technique relating to a filter circuit as a related technique.

CITATION LIST

Patent Literature

[PTL 1] U.S. Pat. No. 8,766,739 specification

Non Patent Literature

[NPL 1] L. -H. Zhou et al., "Tunable filtering balun with enhanced stopband rejection," Electronics Letters, vol. 48, no. 14, pp. 845-847, July 2012

[NPL 2] Lap Kun Yeung and Ke-Li Wu, "A Dual-Band Coupled-Line Balun Filter," IEEE Trans. Microw. Theory Tech., vol. 55, no. 11, pp. 2406-2411, November 2007

SUMMARY OF THE INVENTION

Technical Problem

However, in the balun bandpass filter circuit described in PTL 1 and NPL 1, a variable range of a central frequency of a bandpass band is restricted by a capacity value of a loaded variable capacitance, and therefore it is difficult to largely change a frequency.

Further, in the case of a dual-band balun bandpass filter circuit described in NPL 2, signals of a plurality of frequency bands are caused to pass at the same time, and therefore an unnecessary wave included in a band outside is also caused to pass in addition to a desired signal, resulting in degradation of interference resistance performance.

An object of the present invention is to provide a filter circuit and a frequency switching method that solve the above-described problems.

The present invention is intended to provide a filter circuit capable of solving the above-described problems.

Solution to the Problem

In order to achieve the above-described object, the present invention relates to a filter circuit including: a first transmission line that has an electrical length that is one sixth of a first wavelength corresponding to a first frequency; a second transmission line that has an electrical length that is one sixth of the first wavelength and is disposed to be opposed to the first transmission line separately from each other; an input terminal connected to a first end of two ends in a direction to which current in the first transmission line flows; a third transmission line that has an electrical length that is one sixth of the first wavelength; a fourth transmission line that has an electrical length that is one sixth of the first wavelength and is disposed to be opposed to the third transmission line separately from each other; a first output terminal connected to a first end of two ends in a direction to which current in the fourth transmission line flows; a second output terminal connected to a second end of two ends in a direction to which current in the fourth transmission line flows; a first open end that has a predetermined electrical length and includes a first end connected to a first end of the second transmission line opposed to a second end of two ends in a direction to which current in the first transmission line flows, and a second end that is open; a second open end that has a predetermined electrical length and includes a first end connected to a first end of the third transmission line opposed to a second end of two ends in a direction to which current in the fourth transmission line flows, and a second end that is open; a fifth transmission line that includes a first end connected to a second end of the second transmission line; a sixth transmission line that includes a first end connected to a second end of the third transmission line and is disposed in such a way that at least a part of the sixth transmission line is separately opposed to at least a part of the fifth transmission line; a first switch that is disposed between a second terminal of the fifth transmission line and a ground and causes the second terminal of the fifth transmission line and the ground to be in a connection state or an open state; and a second switch that is disposed between a second terminal of the sixth transmission line and the ground and causes the second terminal of the sixth transmission line and the ground to be in a connection state or an open state, wherein an electrical length of a transmission line that includes the first open end, the second transmission line, and the fifth transmission line is three quarters of a second wavelength corresponding to a second frequency that is higher than the first frequency, and an electrical length of a transmission line that includes the second open end, the third transmission line, and the sixth transmission line is three quarters of the second wavelength.

Further, the present invention relates to a frequency switching method including: a step of opening a first switch and a second switch in the filter circuit; and a step of short-circuiting the first switch and the second switch.

Advantageous Effects of the Invention

According to the present invention, with a simple configuration, radio wave interference can be avoided and a frequency band can be efficiently used.

EXAMPLE EMBODIMENT

First Example Embodiment

A filter circuit according to a first example embodiment of the present invention will be described.

The filter circuit according to the first example embodiment of the present invention is a filter circuit having a minimum configuration in the present invention.

Figure 1:
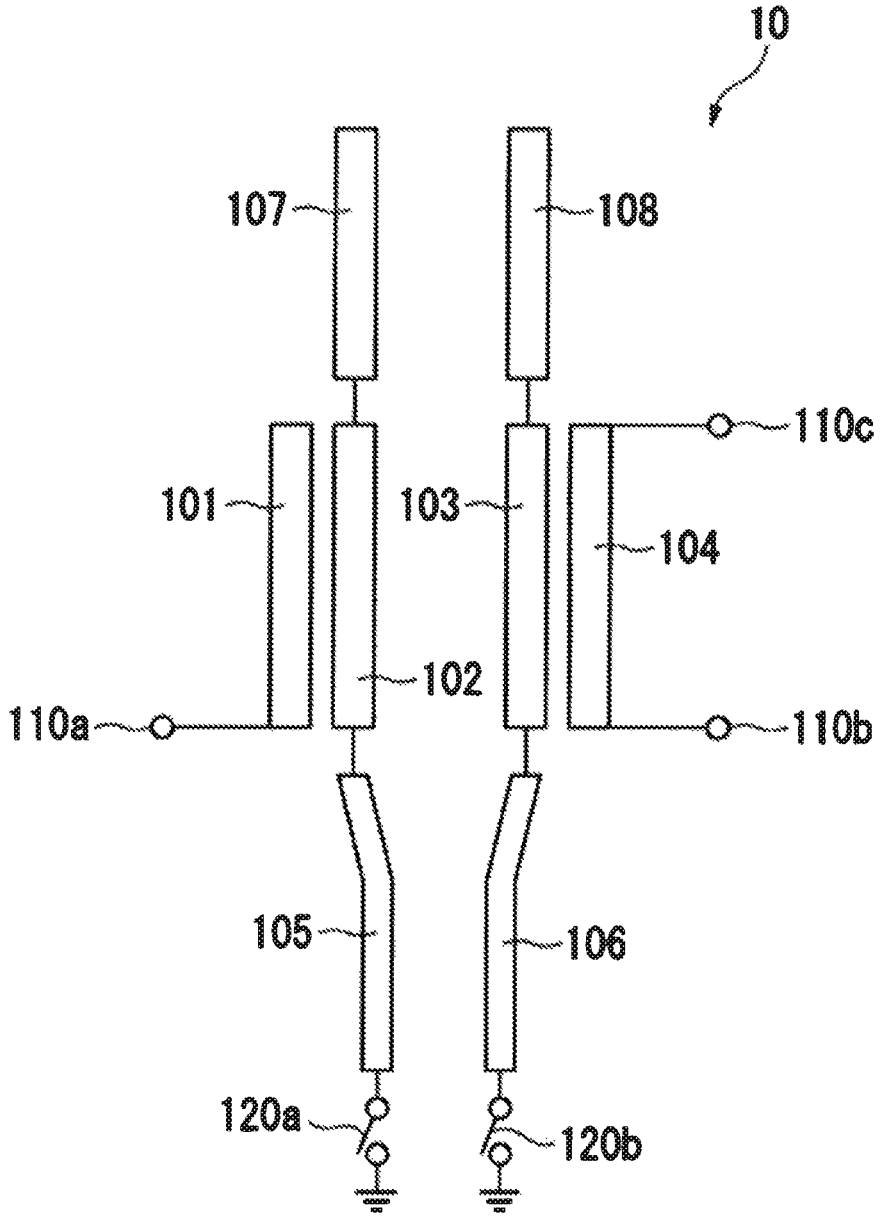
FIG. 1 is a diagram illustrating a configuration of a filter circuit according to a first example embodiment of the present invention.

A filter circuit 10 according to the first example embodiment of the present invention includes, as illustrated in FIG. 1, at least a first transmission line 101, a second transmission line 102, a third transmission line 103, a fourth transmission line 104, a fifth transmission line 105, a sixth transmission line 106, a first open end 107, a second open end 108, an input terminal 110*a*, a first output terminal 110*b*, a second output terminal 110*c*, a first switch 120*a*, and a second switch 120*b*.

An electrical length of each of the first transmission line 101 and the second transmission line 102 is one sixth of a first wavelength λ1. The electrical length is an electrical length normalized by a wavelength of a signal flowing inside a transmission line. In a case where, for example, an electrical length of a given transmission line is one quarter of a wavelength, when an amplitude of a signal of a wavelength is maximum at a first end of the transmission line, an amplitude of the signal is minimum at a second end. In this case, a physical length of the transmission line is not necessarily one quarter of the wavelength. The first wavelength λ1 is a wavelength of a first signal and is a wavelength corresponding to a first frequency f1. The first transmission line 101 and the second transmission line 102 are disposed to be opposed separately from each other, as illustrated in FIG. 1.

The input terminal 110*a* is connected to a first end of two ends in a direction where current in the first transmission line 101 flows.

An electrical length of each of the third transmission line 103 and the fourth transmission line 104 is one sixth of the first wavelength λ1. The third transmission line 103 and the fourth transmission line 104 are disposed to be opposed separately from each other.

The first output terminal 110*b* is connected to a first end of two ends in a direction where current in the fourth transmission line 104 flows.

The second output terminal 110*c* is connected to a second end of the two ends in the direction where current in the fourth transmission line 104 flows.

An electrical length of the first open end 107 is a predetermined electrical length.

A first end of the first open end 107 is connected to a first end of the second transmission line 102 opposed to a second end of the two ends in the direction where current in the first transmission line 101 flows.

A second end of the first open end 107 is open.

An electrical length of the second open end 108 is a predetermined electrical length.

A first end of the second open end 108 is connected to a first end of the third transmission line 103 opposed to a second end of the two ends in the direction where current in the fourth transmission line 104 flows.

A second end of the second open end 108 is open.

A first end of the fifth transmission line 105 is connected to a second end of the second transmission line 102.

A first end of the sixth transmission line 106 is connected to a second end of the third transmission line 103.

At least a part of the sixth transmission line 106 is separately opposed to at least a part of the fifth transmission line 105.

The first switch 120*a* is disposed between a second terminal of the fifth transmission line 105 and a ground. The first switch 120*a* causes the second terminal of the fifth transmission line 105 and the ground to be in a connection state or an open state.

The second switch 120*b* is disposed between a second terminal of the sixth transmission line 106 and a ground. The second switch 120*b* causes the second terminal of the sixth transmission line 106 and the ground to be in a connection state or an open state.

An electrical length of a transmission line including the first open end 107, the second transmission line 102, and the fifth transmission line 105 is three quarters of a second wavelength λ2. The second wavelength λ2 is a wavelength of a second signal and is a wavelength corresponding to a second frequency f2. The second frequency f2 that is a frequency of the second signal is higher than the first frequency f1 that is a frequency of the first signal.

An electrical length of a transmission line including the second open end 108, the third transmission line 103, and the sixth transmission line 106 is three quarters of the second wavelength λ2.

The filter circuit 10 opens/closes the first switch 120*a* and the second switch 120*b* and thereby may cause a central frequency of a passband to be the first frequency f1 or the second frequency f2.

Processing of the filter circuit 10 according to the first example embodiment of the present invention is described above. The above-described filter circuit 10 includes a first transmission line 101 having an electrical length that is one sixth of a first wavelength λ1 corresponding to a first frequency f1. The filter circuit 10 includes a second transmission line 102 having an electrical length that is one sixth of the first wavelength λ1 and being disposed to be opposed to the first transmission line 101 separately from each other. The filter circuit 10 includes an input terminal 110*a* connected to a first end of two ends in a direction where current in the first transmission line 101 flows.

The first circuit 10 includes a third transmission line 103 having an electrical length that is one sixth of the first wavelength λ1. The filter circuit 10 includes a fourth transmission line 104 having an electrical length that is one sixth of the first wavelength λ1 and being disposed to be opposed to the third transmission line 103 separately from each other.

The filter circuit 10 includes a first output terminal 110*b* connected to a first end of two ends in a direction where current in the fourth transmission line 104 flows. The filter circuit 10 includes a second output terminal 110*c* connected to a second end of the two ends in the direction where current in the fourth transmission line 104 flows.

The filter circuit 10 includes a first open end 107 having a predetermined electrical length and including a first end connected to a first end of the second transmission line 102 opposed to a second end of the two ends in the direction where current in the first transmission line 101 flows and a second end that is open. The filter circuit 10 includes a second open end 108 having a predetermined electrical length and including a first end connected to a first end of the third transmission line 103 opposed to a second end of the two ends in the direction where current in the fourth transmission line 104 flows and a second end that is open.

The filter circuit 10 includes a fifth transmission line 105 including a first end connected to a second end of the second transmission line 102. The filter circuit 10 includes a sixth transmission line 106 including a first end connected to a second end of the third transmission line 103 and being disposed in such a way that at least a part of the sixth transmission line 106 is separately opposed to at least a part of the fifth transmission line 105.

The filter circuit 10 includes a first switch 120*a* being disposed between a second terminal of the fifth transmission line 105 and a ground and causing the second terminal of the fifth transmission line 105 and the ground to be in a connection state or an open state. The filter circuit 10 includes a second switch 120*b* being disposed between a second terminal of the sixth transmission line 106 and a ground and causing the second terminal of the sixth transmission line 106 and the ground to be in a connection state or an open state.

An electrical length of a transmission line including the first open end 107, the second transmission line 102, and the fifth transmission line 105 is one half of a second wavelength λ2 corresponding to a second frequency f2 that is higher than the first frequency f1. An electrical length of a transmission line including the second open end 108, the third transmission line 103, and the sixth transmission line 106 is three quarters of the second wavelength λ2.

By doing in such a manner, the filter circuit 10 can avoid radio wave interference by causing only a signal of a desired frequency to pass through a simple configuration and can efficiently use a frequency band by causing signals of largely different frequencies to pass.

Second Example Embodiment

A filter circuit 10 according to a second example embodiment of the present invention is described.

Figure 2:
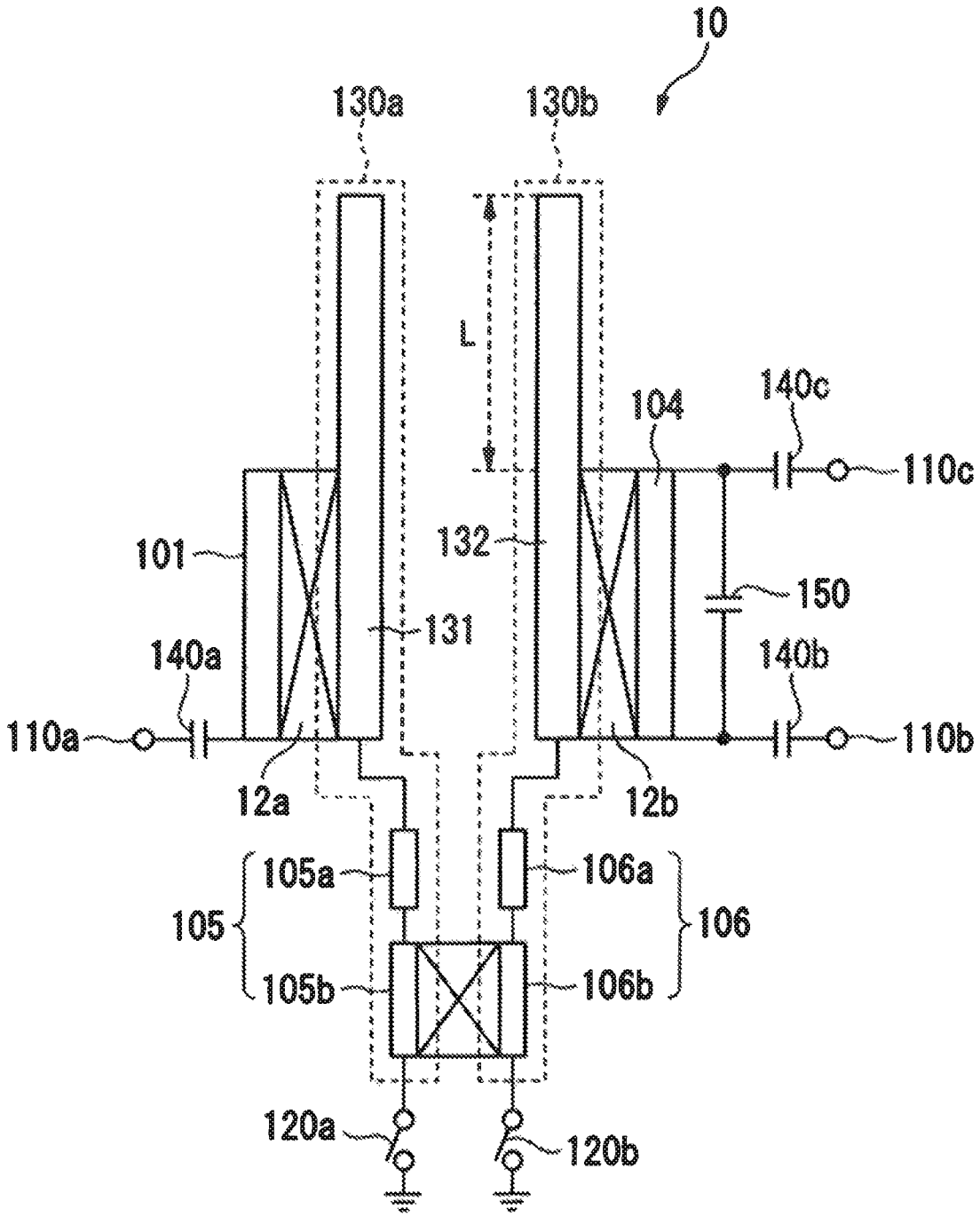
FIG. 2 is a diagram illustrating configuration of a filter circuit according to a second example embodiment of the present invention.

The filter circuit 10 according to the second example embodiment of the present invention includes, as illustrated in FIG. 2, a first main transmission line 130*a*, a second main transmission line 130*b*, a first sub-transmission line 101, a second sub-transmission line 104, an input terminal 110*a*, a first output terminal 110*b*, a second output terminal 110*c*, a first switch 120*a*, a second switch 120*b*, a first capacitor 140*a*, a second capacitor 140*b*, a third capacitor 140*c*, and a fourth capacitor 150.

The first main transmission line 130*a* includes a first sub-coupling unit 131 and a first main coupling unit 105. The first main coupling unit 105 includes a first connection unit 105*a* and a first coupling unit 105*b*.

The first sub-coupling unit 131 is one example of the second transmission line 102 and the first open end 107 according to the first example embodiment.

The first connection unit 105*a* and the first coupling unit 105*b* are one example of the fifth transmission line 105 according to the first example embodiment.

The second main transmission line 130*b* includes a second sub-coupling unit 132 and a second main coupling unit 106. The second main coupling unit 106 includes a second connection unit 106*a* and a second coupling unit 106*b*.

The second sub-coupling unit 132 is one example of the third transmission line 103 and the second open end 108 according to the first example embodiment.

The second connection unit 106*a* and the second coupling unit 106*b* are one example of the sixth transmission line 106 according to the first example embodiment.

The first sub-transmission line 101 is one example of the first transmission line 101 according to the first example embodiment.

The second sub-transmission line 104 is one example of the fourth transmission line 104 according to the first example embodiment.

The filter circuit 10 according to the second example embodiment may selectively cause an intermediate frequency of a passband to be a first frequency f1 or a second frequency f2.

The second frequency f2 in the second example embodiment is 1.5 times of the first frequency f1.

Hereinafter, a frequency that is "n times of a frequency f" is not limited to a frequency that is exactly n times of a frequency f. A frequency that is "n times of a frequency f" may include a frequency near a frequency that is exactly n times of a frequency f.

The filter circuit 10 includes a transmission line such as a micro-strip line and the like. The filter circuit 10 is realized by forming, using a conductive foil, a transmission line on a surface of a dielectric substrate having a back face formed with a conductive foil.

Specifically, each of the first main transmission line 130*a*, the second main transmission line 130*b*, the first sub-transmission line 101, and the second sub-transmission line 104 is formed on a surface of a dielectric substrate. Each of the first main transmission line 130*a*, the second main transmission line 130*b*, the first sub-transmission line 101, and the second sub-transmission line 104 is a transmission line extending in a Y-axis direction. Further, when XY axes are set on a surface of a dielectric substrate, the first main transmission line 130*a*, the second main transmission line 130*b*, the first sub-transmission line 101, and the second sub-transmission line 104 are disposed side by side in an X-axis direction orthogonal to the Y axis.

Current flows in a longitudinal direction (Y-axis direction) of each of the first main transmission line 130*a*, the second main transmission line 130*b*, the first sub-transmission line 101, and the second sub-transmission line 104.

An electrical length of each of the first main transmission line 130*a* and the second main transmission line 130*b* is an electrical length that is one half of a first wavelength λ1. A second frequency f2 in the second example embodiment is 1.5 times of a first frequency f1. Therefore, an electrical length of each of the first main transmission line 130*a* and the second main transmission line 130*b* is three quarters of a second wavelength λ2.

An electrical length of each of the first sub-transmission line 101 and the second sub-transmission line 104 is one sixth of the first wavelength λ1. A second frequency f2 in the second example embodiment is 1.5 times of a first frequency f1. Therefore, an electrical length of each of the first sub-transmission line 101 and the second sub-transmission line 104 is one quarter of the second wavelength λ2.

An electrical length of "m times of a wavelength λ," is not limited to an electrical length that is exactly m times of a wavelength λ. An electrical length that is "m times of a wavelength λ," may be an electrical length that is shorter or longer than an electrical length that is exactly m times of a wavelength λ, and may include an electrical length excited to a signal of the wavelength λ.

A case where, for example, a first frequency f1 is 1.6 GHz, a relative permittivity εr of a dielectric substrate is 3.5, and a thickness of the substrate is 0.76 millimeters is considered. When a characteristic impedance is assumed to be 50 ohms, an electrical length of one quarter of a wavelength λ1 corresponding to the first frequency f1 may include an electrical length in a vicinity of 28 millimeters such as 27 millimeters, 29 millimeters and the like, in addition to 28 millimeters.

An electrical length may be calculated using an empirical equation such as the following equations (1) to (3) described in, for example, "Yoshihiro Konishi, "Practical Microwaves Technical Courses: Theory and Practice, Volume 1".

[Math. 1]

$$\frac{W_0}{h} = \frac{\sqrt[8]{\left\{\exp\left(\frac{Z_c\sqrt{\varepsilon_r+1}}{42.4}\right)-1\right\}\frac{7+\frac{4}{\varepsilon_r}}{11}+\frac{1+\frac{1}{\varepsilon_r}}{0.81}}}{\exp\left(\frac{Z_c\sqrt{\varepsilon_r+1}}{42.4}\right)-1} \tag{1}$$

[Math. 2]

$$\varepsilon_w = \frac{\varepsilon_r+1}{2}+\frac{\varepsilon_r-1}{2}\left(1+\frac{10h}{W_0}\right)^{-1/2}-\frac{\varepsilon_r-1}{4.6}\frac{t/h}{\sqrt{W_0/h}} \tag{2}$$

[Math. 3]

$$\lambda/4 = \frac{c}{f}\frac{1}{\sqrt{\varepsilon_w}}\frac{1}{4} \tag{3}$$

Herein, $W_0$ is a width of a line. A symbol h is a thickness of a substrate. A symbol $\varepsilon_w$ is an effective permittivity. A symbol t is a film thickness of metal (a line). A symbol c is a velocity of light.

Calculation of an electrical length is not limited to calculation using the equations (1) to (3). Calculation of an electrical length may be calculation using an empirical equation other than the equations (1) to (3). Further, calculation of an electrical length may be calculation using, for example, a design tool. However, an electric length to be calculated has a slight difference depending on an equation used for the calculation.

The first main transmission line 130*a* and the second main transmission line 130*b* are disposed in such a way that a part of each line is opposed to and separate from each other.

A part of the first sub-coupling unit 131 is disposed to be separately opposed to the first sub-transmission line 101.

A portion of the first sub-coupling unit 131 opposed to the first sub-transmission line 101 and the first-sub-transmission line 101 work as a first sub-coupling line 12*a*.

A portion of the first sub-coupling unit 131 that is not opposed to the first sub-transmission line 101 works as an open stub.

A part of the second sub-coupling unit 132 is disposed to be separately opposed to the second sub-transmission line 104.

A portion of the second sub-coupling unit 132 opposed to the second sub-transmission line 104 and the second sub-transmission line 104 work as a second sub-coupling line 12*b*.

A portion of the second sub-coupling unit 132 that is not opposed to the second sub-transmission line 104 works as an open stub.

A part of the first main coupling unit 105 and a part of the second main coupling unit 106 are disposed to be opposed separately from each other. Specifically, the first coupling unit 105*b* and the second coupling unit 106*b* are disposed to be opposed separately from each other.

A first terminal of the first connection unit 105*a* is connected to a first terminal of the first sub-coupling unit 131.

A second terminal of the first connection unit 105*a* is connected to a first terminal of the first coupling unit 105*b*.

A first terminal of the second connection unit 106*a* is connected to a first terminal of the second sub-coupling unit 132.

A second terminal of the second connection unit 106*a* is connected to a first terminal of the second coupling unit 106*b*.

One end of the first capacitor 140*a* is connected to the input terminal 110*a*. The other end of the first capacitor 140*a* is connected to a first terminal of the first sub-transmission line 101.

One end of the second capacitor 140*b* is connected to the first output terminal 110*b*. The other end of the second capacitor 140*b* is connected to a first terminal of the second sub-transmission line 104.

One end of the third capacitor 140*c* is connected to the second output terminal 110*c*. The other end of the third capacitor 140*c* is connected to a second terminal of the second sub-transmission line 104.

Each of the first capacitor 140*a*, the second capacitor 140*b*, and the third capacitor 140*c* cuts a direct-current component of a signal input to the filter circuit 10. Further, each of the first capacitor 140*a*, the second capacitor 140*b*, and the third capacitor 140*c* matches an input/output impedance of the filter circuit 10.

One end of the fourth capacitor 150 is connected to the first terminal of the second sub-transmission line 104. The other end of the fourth capacitor 150 is connected to the second terminal of the second sub-transmission line 104.

One end of the first switch 120*a* is connected to a second terminal of the first coupling unit 105*b*. The other end of the first switch 120*a* is connected to a ground. When the first switch 120*a* is opened/closed, the second terminal of the first coupling unit 105*b* and the ground are caused to be in an open state or a short-circuited state.

One end of the second switch 120*b* is connected to a second terminal of the second coupling unit 106*b*. The other end of the second switch 120*b* is connected to a ground. When the second switch 120*b* is opened/closed, the second terminal of the second coupling unit 106*b* and the ground are caused to be in an open state or a short-circuited state.

When both of the first switch 120*a* and the second switch 120*b* are caused to be in an open state, the first main transmission line 130*a* and the second main transmission line 130*b* work as a both-end-open half-wavelength resonator. Further, when both of the first switch 120*a* and the second switch 120*b* are caused be in a short-circuited state, the first main transmission line 130*a* and the second main transmission line 130*b* work as a one-end-open resonator with a three-quarter wavelength of a second frequency f2. The one-end-open resonator with a three-quarter wavelength of a second frequency f2 is a resonator capable of acquiring a resonance frequency similarly to a one-end-open resonator with a one-quarter wavelength of the second frequency f2.

An operation of the filter circuit 10 according to the first example embodiment is described.

First, an operation of the filter circuit 10 upon working as a bandpass filter that causes a signal of a first frequency f1 to pass is described.

Figure 3:
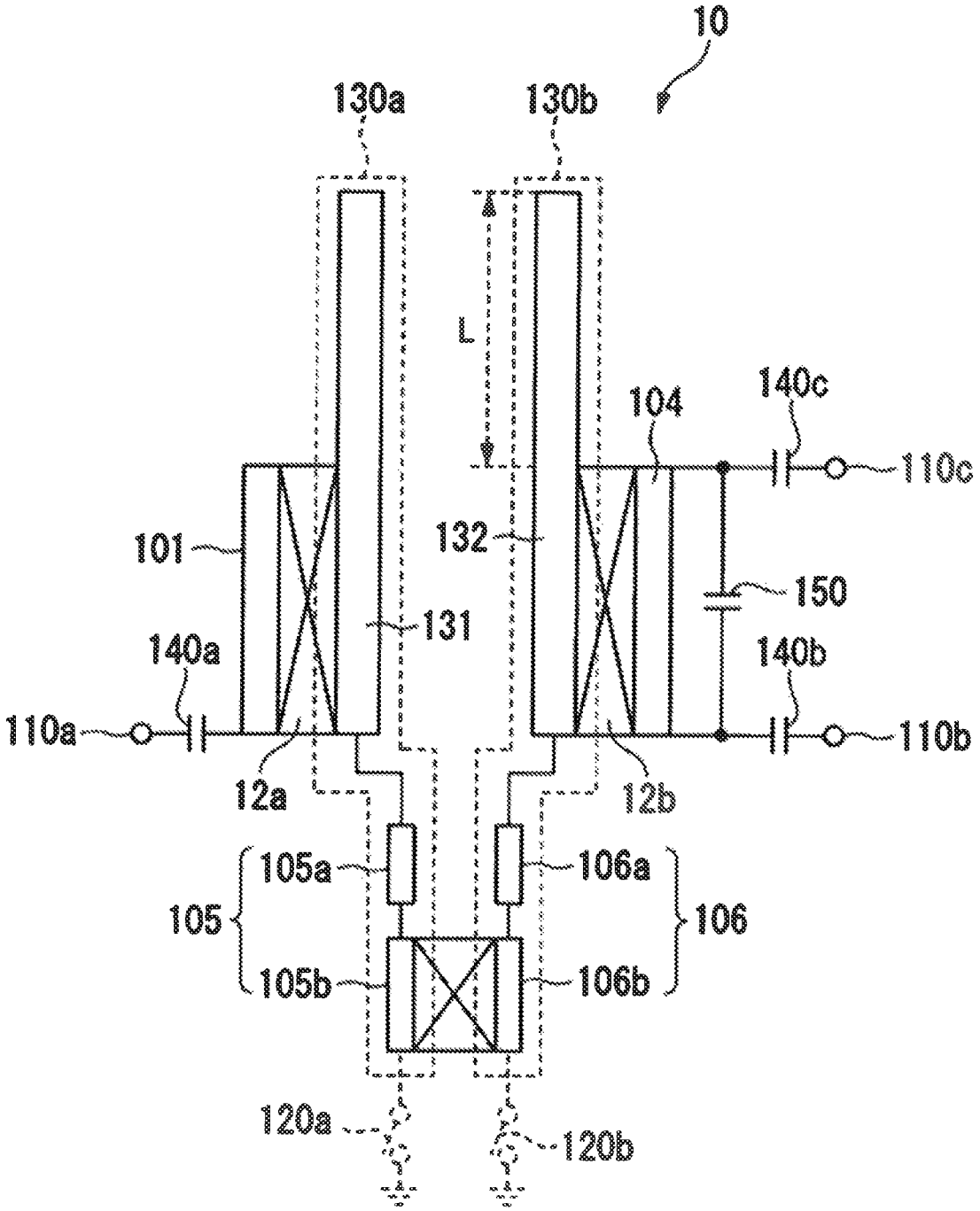
FIG. 3 is a diagram for explaining an operation of a filter circuit in which a signal of a first frequency is caused to pass in the second example embodiment of the present invention.

The filter circuit 10 works as a bandpass filter that causes a signal of a first frequency f1 to pass when both of the first switch 120*a* and the second switch 120*b* are caused to be in an open state as illustrated in FIG. 3.

When a signal is applied to the input terminal 110*a*, a direct-current component of the signal is cut by the first capacitor 140*a*. The signal in which the direct-current component is cut propagates in the first sub-transmission line 101. The signal is transmitted, when propagated in the first sub-transmission line 101, to the first sub-coupling unit 131 that is electromagnetically coupled to the first sub-transmission line 101.

Each of the first switch 120*a* and the second switch 120*b* is in an open state, and therefore the first main transmission line 130*a* and the second main transmission line 130*b* work as a both-end-open transmission line having an electrical length of one half of a wavelength λ1 corresponding to the first frequency f1. In other words, the first main transmission line 130*a* and the second main transmission line 130*b* work as a bandpass filter that causes a signal of the first frequency f1 to pass.

The signal of the first frequency f1 propagated in the first main transmission line 130*a* and the second main transmission line 130*b* is transmitted to the second sub-coupling unit 104 that is electromagnetically coupled to the second sub-coupling unit 132. Thereby, each of the first output terminal 110*b* and the second output terminal 110*c* connected to the second sub-transmission line 104 outputs only the signal of the first frequency f1 among signals applied to the input terminal 110*a*. At that time, ideally, each of the first output terminal 110*b* and the second output terminal 110*c* outputs the signal of the first frequency f1 via even distribution. A phase difference between a signal output by the first output terminal 110*b* and a signal output by the second output terminal 110*c* is 180 degrees. The signal output by the first output terminal 110*b* and the signal output by the second output terminal 110*c* are output as differential output.

Figure 4:
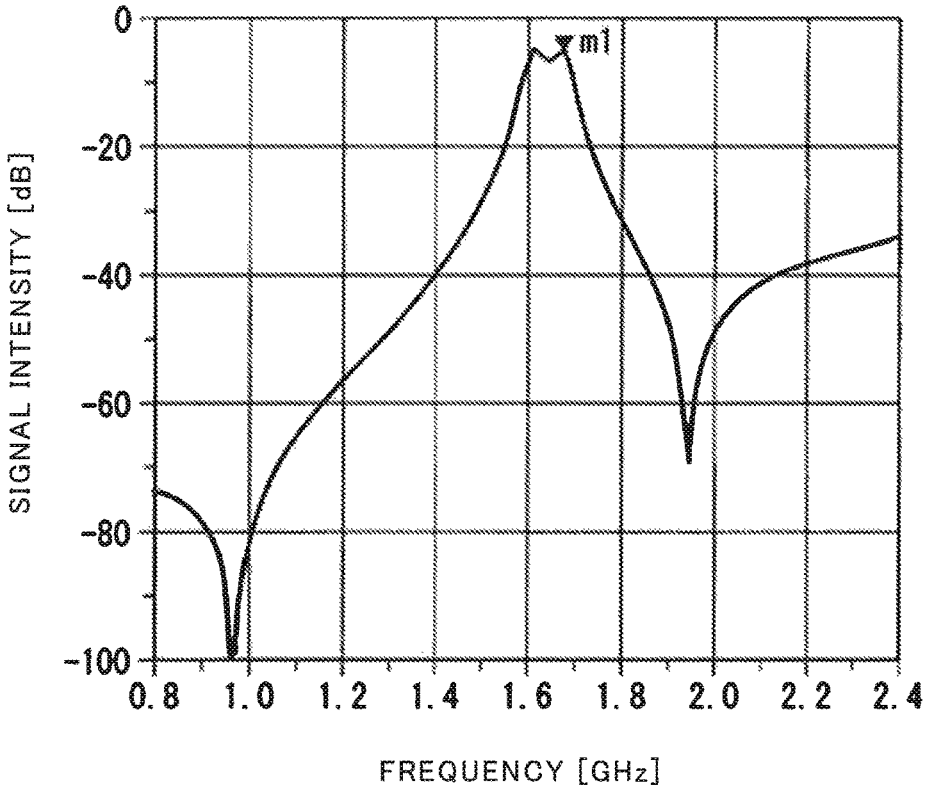
FIG. 4 is a first diagram illustrating transmission characteristics of a filter circuit in which a signal of a first frequency is caused to pass in the second example embodiment of the present invention.
Figure 5:
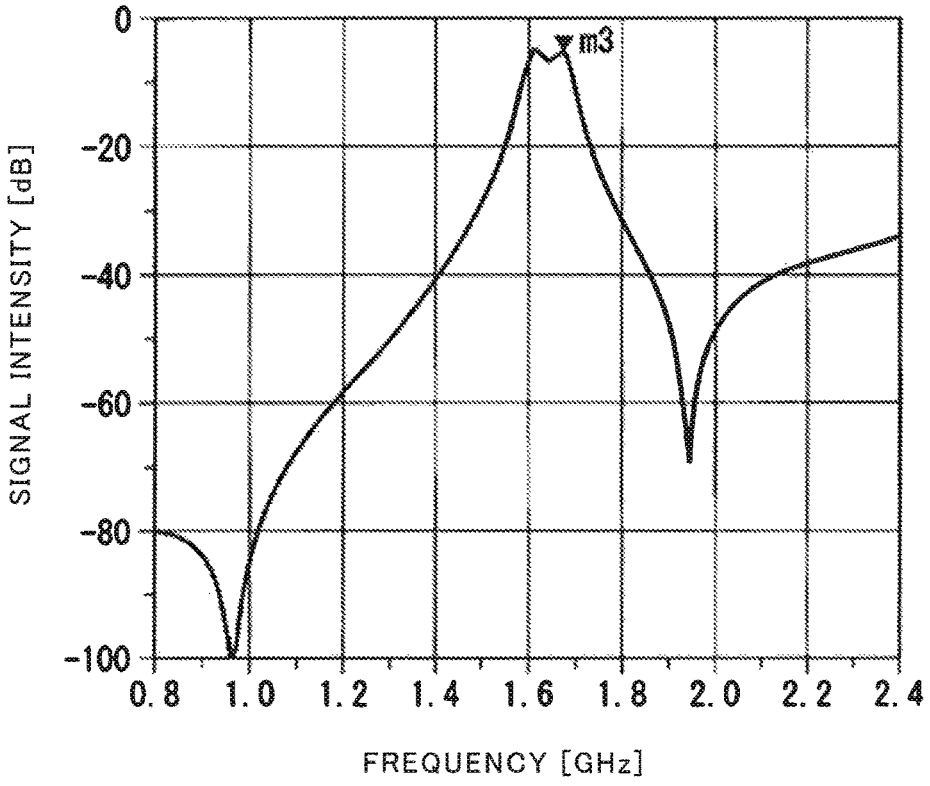
FIG. 5 is a second diagram illustrating transmission characteristics of a filter circuit in which a signal of a first frequency is caused to pass in the second example embodiment of the present invention.
Figure 6:
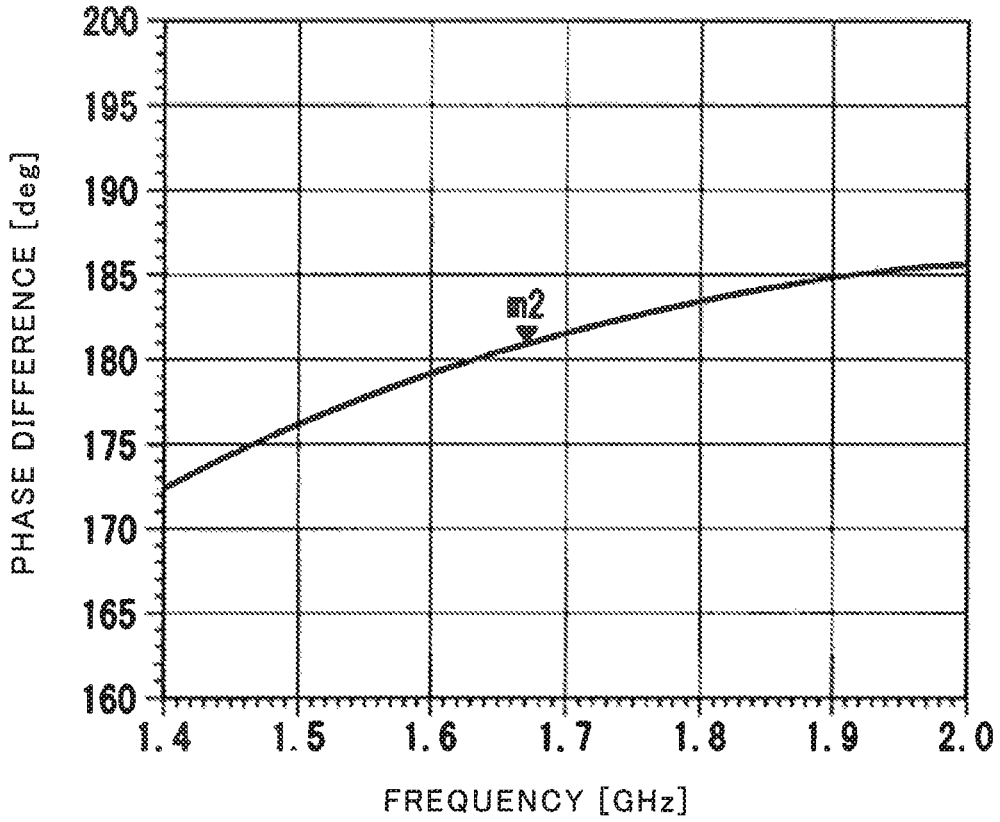
FIG. 6 is a third diagram illustrating transmission characteristics of a filter circuit in which a signal of a first frequency is caused to pass in the second example embodiment of the present invention.

Transmission characteristics determined by simulation of the filter circuit 10 upon working as a bandpass filter that causes a first frequency f1 to pass are characteristics illustrated in FIGS. 4 to 6.

The transmission characteristics illustrated in FIGS. 4 to 6 are characteristics in a case where a first frequency is 1.67 GHz, a second frequency is 2.26 GHz, a permittivity of a dielectric substrate is 3.5, and a thickness of the dielectric substrate is 0.76 millimeters.

It is understood that signal intensity in the first output terminal 110*b* illustrated in FIG. 4 and signal intensity in the second output terminal 110*c* illustrated in FIG. 5 are substantially the same and this fact indicates a nearly ideal state.

Further, from FIG. 6, it is understood that a phase difference between a signal at the first output terminal 110*b* of the filter circuit 10 and a signal at the second output terminal 110*c* of the filter circuit 10 is approximately 181 degrees when a frequency of the signal is 1.67 GHz and this fact indicates a nearly ideal state.

As described above, the filter circuit 10 according to the second example embodiment of the present invention works as a bandpass filter that causes a first frequency f1 to pass when each of the first switch 120*a* and the second switch 120*b* is in an open state.

Next, an operation of the filter circuit 10 upon working as a bandpass filter that causes a signal of a second frequency f2 to pass is described.

Figure 7:
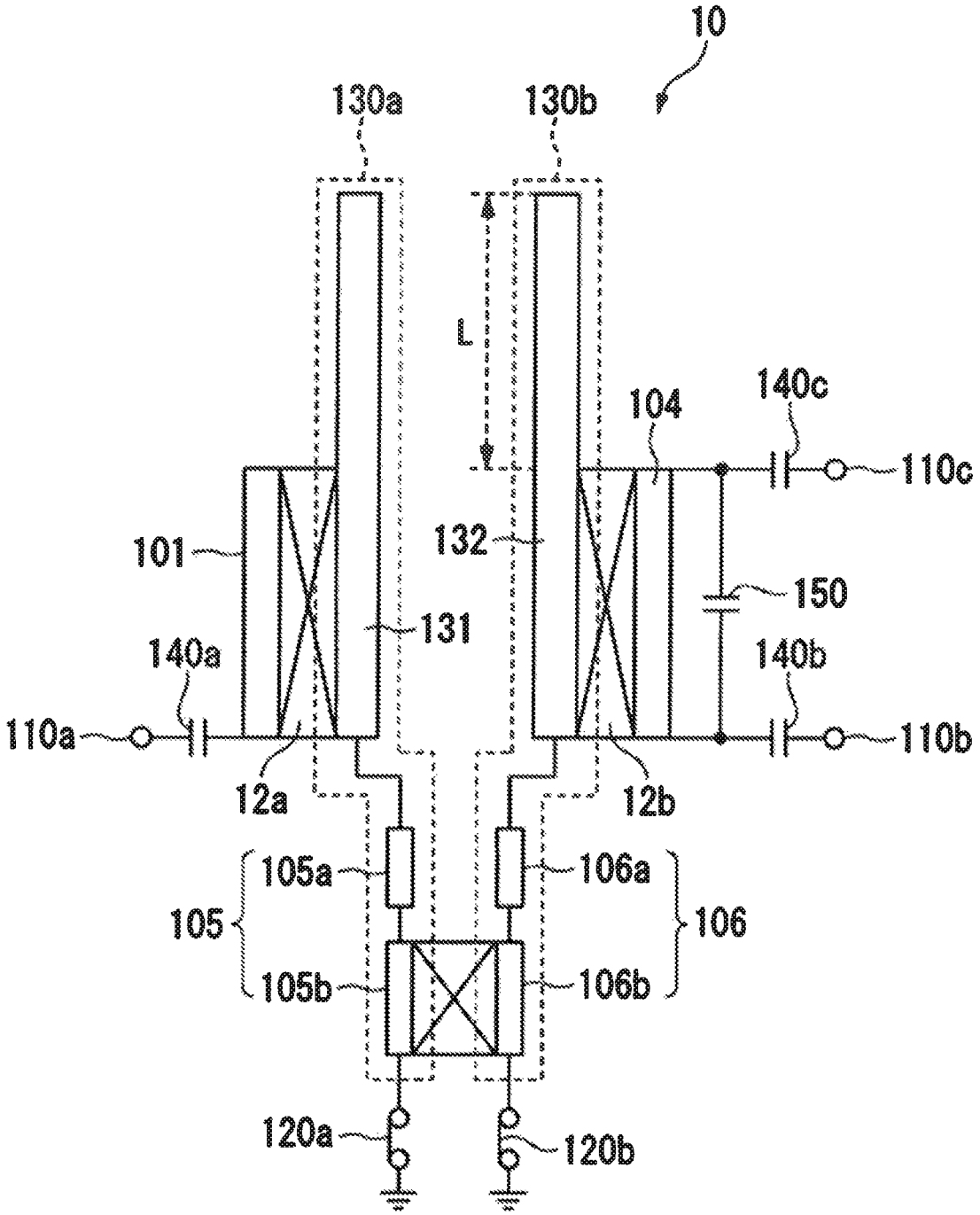
FIG. 7 is a diagram for explaining an operation of a filter circuit in which a signal of a second frequency is caused to pass in the second example embodiment of the present invention.

The filter circuit 10 works as a bandpass filter that causes a signal of a second frequency f2 to pass when both of the first switch 120*a* and the second switch 120*b* are caused to be in a short-circuited state as illustrated in FIG. 7.

When a signal is applied to the input terminal 110*a*, a direct-current component of the signal is cut by the first capacitor 140*a*. The signal in which the direct-current component is cut propagates in the first sub-transmission line 101. The signal is transmitted, when propagated in the first sub-transmission line 101, to the first sub-coupling unit 131 that is electromagnetically coupled to the first sub-transmission line 101.

Each of the first switch 120*a* and the second switch 120*b* is in a short-circuited state. Therefore, the first main transmission line 130*a* and the second main transmission line 130*b* work as a one-end-open three-quarter-wavelength resonator having an electrical length of three quarters of a wavelength λ2 corresponding to the second frequency f2, equivalently a one-end-open quarter-wavelength resonator. In other words, the first main transmission line 130*a* and the second main transmission line 130*b* work as a bandpass filter that causes a signal of the second frequency f2 that is a frequency of 1.5 times of the first frequency f1 to pass.

The signal of the first frequency f2 propagated in the first main transmission line 130*a* and the second main transmission line 130*b* is transmitted to the second sub-coupling unit 104 that is electromagnetically coupled to the second sub-coupling unit 132. Thereby, each of the first output terminal 110*b* and the second output terminal 110*c* connected to the second sub-transmission line 104 outputs only the signal of the second frequency f2 among signals applied to the input terminal 110*a*. At that time, ideally, each of the first output terminal 110*b* and the second output terminal 110*c* outputs the signal of the second frequency f2 via even distribution. A phase difference between a signal output by the first output terminal 110*b* and a signal output by the second output terminal 110*c* is 180 degrees. The signal output by the first output terminal 110*b* and the signal output by the second output terminal 110*c* are output as differential output.

Figure 8:
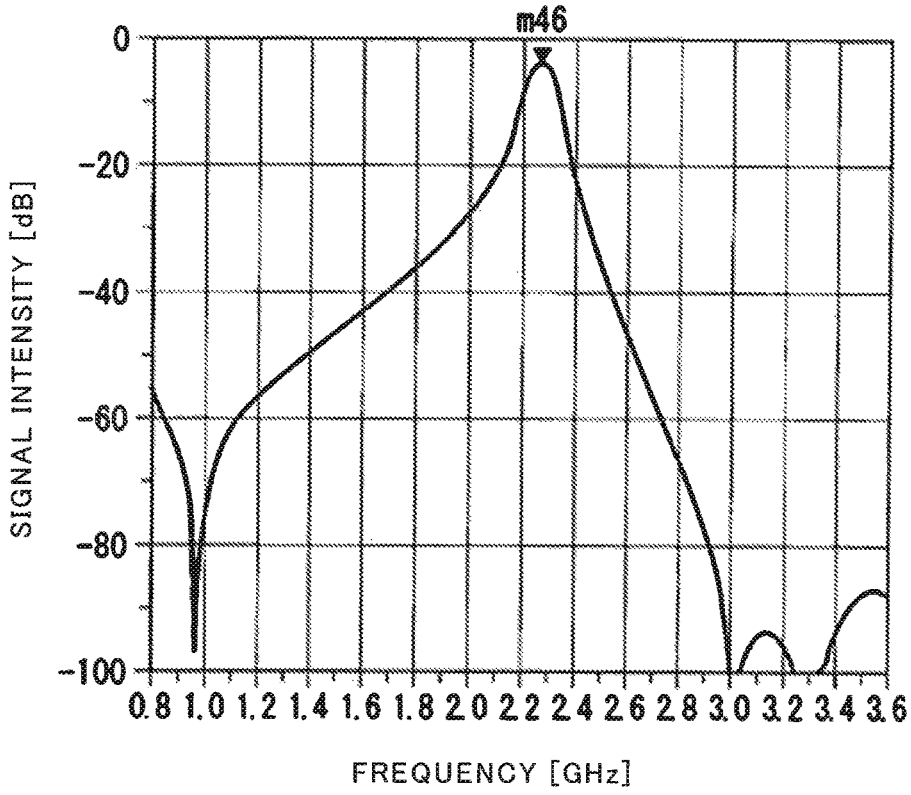
FIG. 8 is a first diagram illustrating a transmission characteristic of a filter circuit in which a signal of a second frequency is caused to pass in the second example embodiment of the present invention.
Figure 9:
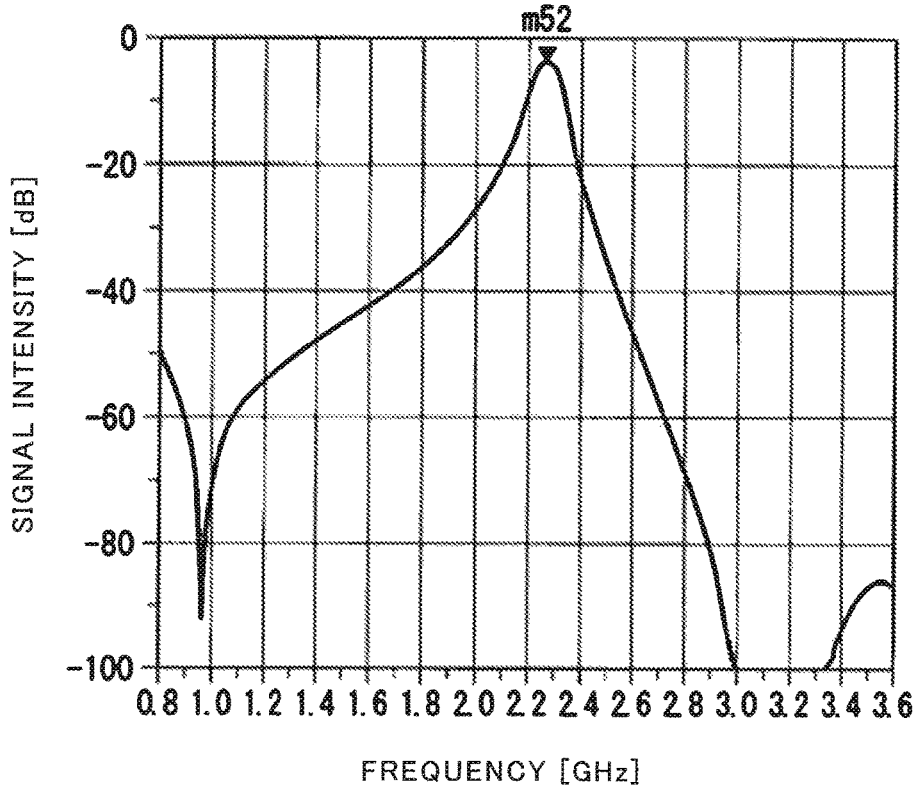
FIG. 9 is a second diagram illustrating a transmission characteristic of a filter circuit in which a signal of a second frequency is caused to pass in the second example embodiment of the present invention.
Figure 10:
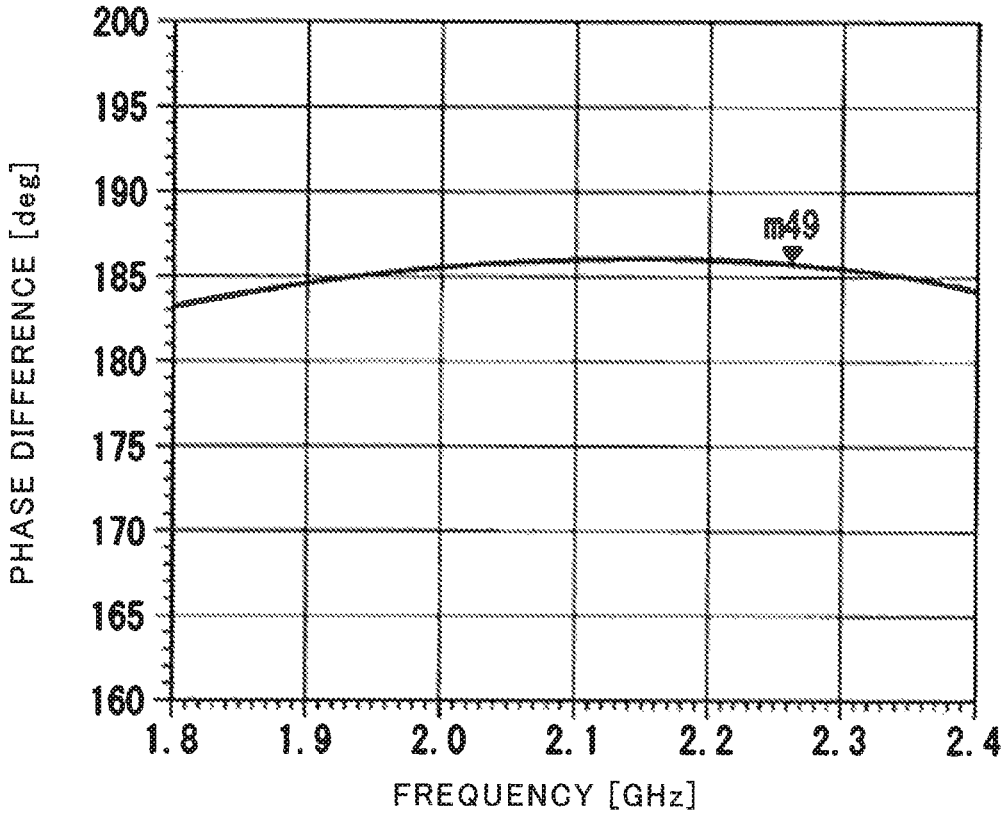
FIG. 10 is a third diagram illustrating a transmission characteristic of a filter circuit in which a signal of a second frequency is caused to pass in the second example embodiment of the present invention.

Transmission characteristics of the filter circuit 10 upon working as a bandpass filter that causes a second frequency f2 to pass are characteristics illustrated in FIGS. 8 to 10.

The transmission characteristics illustrated in FIGS. 8 to 10 are characteristics in a case where a first frequency is 1.67 GHz, a second frequency is 2.26 GHz, a permittivity of a dielectric substrate is 3.5, and a thickness of the dielectric substrate is 0.76 millimeters.

From FIG. 8 and FIG. 9, it is understood that signal intensity in the first output terminal 110*b* of the filter circuit 10 and signal intensity in the second output terminal 110*c* of the filter circuit 10 are substantially the same and this fact indicates a nearly ideal state.

Further, from FIG. 10, it is understood that a phase difference between a signal in the first output terminal 110*b* of the filter circuit 10 and a signal in the second output terminal 110*c* of the filter circuit 10 is approximately 186 degrees when a frequency of the signal is 2.26 GHz and this fact indicates a nearly ideal state.

As described above, the filter circuit 10 according to the second example embodiment of the present invention works as a bandpass filter that causes a second frequency f2 to pass when each of the first switch 120*a* and the second switch 120*b* is in a short-circuited state.

Processing of the filter circuit 10 according to the second example embodiment of the present invention is described above. The above-described filter circuit 10 includes a first transmission line 101 having an electrical length that is one sixth of a first wavelength λ1 corresponding to a first frequency f1. The filter circuit 10 includes a second transmission line 102 having an electrical length that is one sixth of the first wavelength λ1 and being disposed to be opposed to the first transmission line 101 separately from each other. The filter circuit 10 includes an input terminal 110*a* connected to a first end of two ends in a direction where current in the first transmission line 101 flows.

The first circuit 10 includes a third transmission line 103 having an electrical length that is one sixth of the first wavelength λ1. The filter circuit 10 includes a fourth transmission line 104 having an electrical length that is one sixth of the first wavelength λ1 and being disposed to be opposed to the third transmission line 103 separately from each other. The filter circuit 10 includes a first output terminal 110*b* connected to a first end of two ends in a direction where current in the fourth transmission line 104 flows. The filter circuit 10 includes a second output terminal 110*c* connected to a second end of the two ends in the direction where current in the fourth transmission line 104 flows.

The filter circuit 10 includes a first open end 107 having a predetermined electrical length and including a first end connected to a first end of the second transmission line 102 opposed to a second end of the two ends in the direction where current in the first transmission line 101 flows and a second end that is open. The filter circuit 10 includes a second open end 108 having a predetermined electrical length and including a first end connected to a first end of the third transmission line 103 opposed to a second end of the two ends in the direction where current in the fourth transmission line 104 flows and a second end that is open.

The filter circuit 10 includes a fifth transmission line 105 including a first end connected to a second end of the second transmission line 102. The filter circuit 10 includes a sixth transmission line 106 including a first end connected to a second end of the third transmission line 103 and being disposed in such a way that at least a part of the sixth transmission line 106 is separately opposed to at least a part of the fifth transmission line 105.

The filter circuit 10 includes a first switch 120*a* being disposed between a second terminal of the fifth transmission line 105 and a ground and causing the second terminal of the fifth transmission line 105 and the ground to be in a connection state or an open state. The filter circuit 10 includes a second switch 120*b* being disposed between a second terminal of the sixth transmission line 106 and a ground and causing the second terminal of the sixth transmission line 106 and the ground to be in a connection state or an open state.

An electrical length of a transmission line including the first open end 107, the second transmission line 102, and the fifth transmission line 105 is three quarters of a second wavelength λ2 corresponding to a second frequency f2 that is higher than the first frequency f1. An electrical length of a transmission line including the second open end 108, the third transmission line 103, and the sixth transmission line 106 is three quarters of the second wavelength λ2.

By doing in such a manner, the filter circuit 10 can avoid radio wave interference by causing only a signal of a desired frequency to pass through a simple configuration and can efficiently use a frequency band by causing signals of largely different frequencies to pass.

Further, a second wavelength λ2 corresponding to a second frequency f2 is 1.5 times of a first wavelength λ1 corresponding to a first frequency f1. The first open end 107 and the second open end 108 have an electrical length that is one quarter of the second frequency f2.

By causing the first open end 107 and the second open end 108 to be an open stub in this manner, the filter circuit 10 can avoid radio wave interference by causing only a signal of a desired frequency to pass through a simple configuration. In addition thereto, the filter circuit 10 can efficiently use a frequency band by causing signals of largely different frequencies to pass.

Third Example Embodiment

Figure 11:
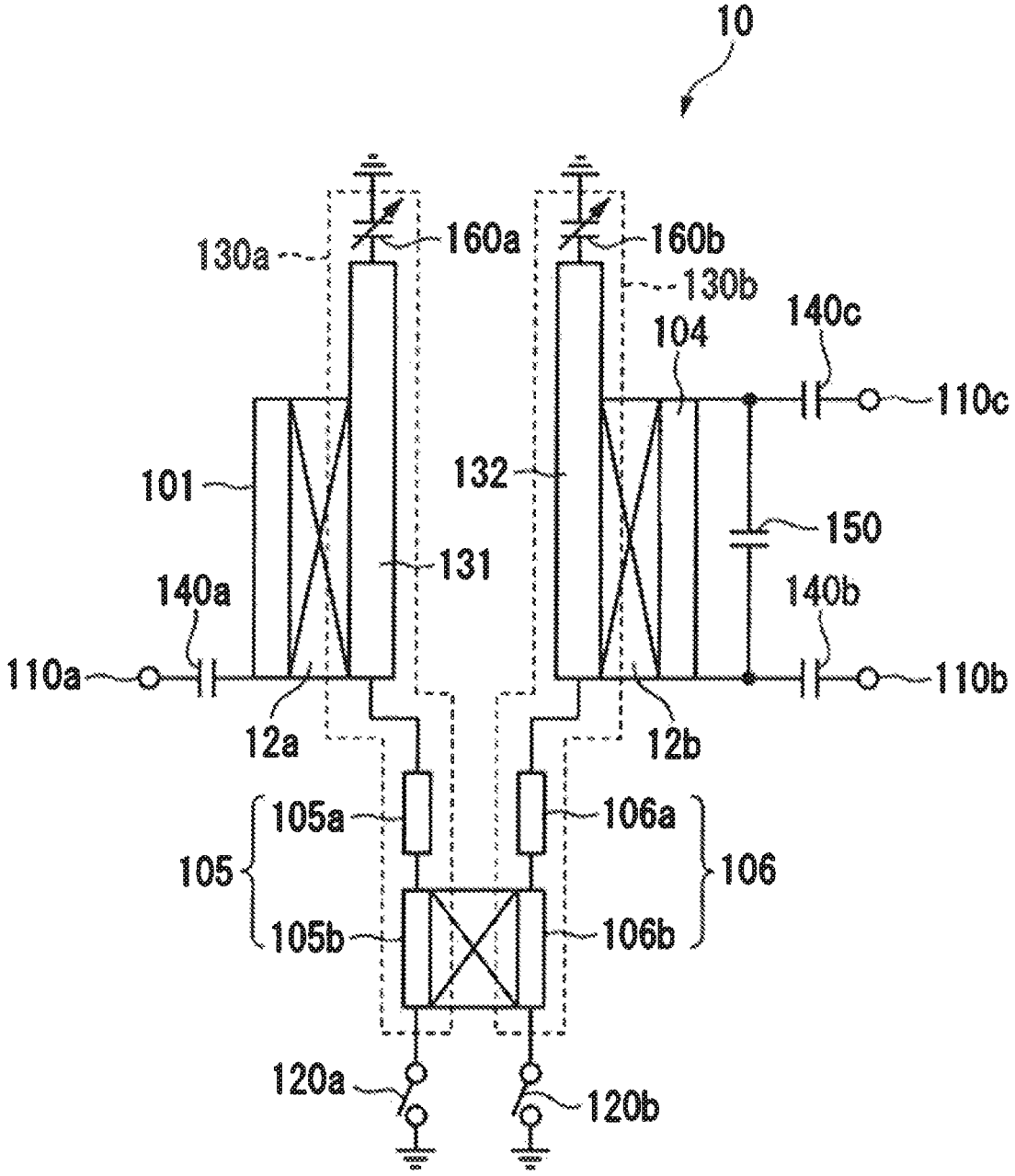
FIG. 11 is a diagram illustrating a configuration of a filter circuit in a third example embodiment of the present invention.

A filter circuit 10 according to a third example embodiment of the present invention is described using FIG. 11.

The filter circuit 10 according to the present example embodiment includes, similarly to the filter circuit 10 according to the second example embodiment, a first main transmission line 130*a*, a second main transmission line 130*b*, a first sub-transmission line 101, a second sub-transmission line 104, an input terminal 110*a*, a first output terminal 110*b*, a second output terminal 110*c*, a first switch 120*a*, a second switch 120*b*, a first capacitor 140*a*, a second capacitor 140*b*, a third capacitor 140*c*, and a fourth capacitor 150.

However, the first main transmission line 130*a* according to the present example embodiment is different from the first main transmission line 130*a* according to the second example embodiment. Further, the second main transmission line 130*b* according to the present example embodiment is different from the second main transmission line 130*b* according to the second example embodiment.

The first main transmission line 130*a* according to the third example embodiment of the present invention includes a first sub-coupling unit 131, a first main coupling unit 105, and a first variable capacitor 160*a*.

One end of the first variable capacitor 160*a* is connected to a second terminal of the first sub-coupling unit 131. The other end of the first variable capacitor 160*a* is connected to a ground.

One end of the first variable capacitor 160*a* is connected to a second terminal of the first sub-coupling unit 131, and the other end of the first variable capacitor 160*a* is connected to the ground. Thereby, the second terminal of the first sub-coupling unit 131 becomes a circuit equivalent to an open stub in the second terminal of the first sub-coupling unit 131 according to the second example embodiment.

As a result, the first sub-coupling unit 131 according to the third example embodiment of the present invention operates similarly to the first sub-coupling unit 131 according to the second example embodiment.

The second main transmission line 130*b* according to the third example embodiment of the present invention includes a second sub-coupling unit 132, a second main coupling unit 106, and a second variable capacitor 160*b*.

One end of the second variable capacitor 160*b* is connected to a second terminal of the second sub-coupling unit 132. The other end of the second variable capacitor 160*b* is connected to a ground.

One end of the second variable capacitor 160*b* is connected to the second terminal of the second sub-coupling unit 132, and the other end of the second variable capacitor 160*b* is connected to the ground. Thereby, the second terminal of the second sub-coupling unit 132 becomes a circuit equivalent to an open stub in the second terminal of the second sub-coupling unit 132 according to the second example embodiment of the present invention.

As a result, the second sub-coupling unit 132 according to the present example embodiment operates similarly to the second sub-coupling unit 132 according to the second example embodiment.

An electrical length of a portion of the first sub-coupling unit 131 that is not opposed to the first sub-transmission line 101 may be changed to any electrical length in an extent of a variable range of electrostatic capacitance of a variable capacitor by changing electrostatic capacitance of the first variable capacitor 160*a* and the second variable capacitor 160*b*. In other words, in the third example embodiment of the present invention, a second frequency f2 is not necessarily 1.5 times of a first frequency f1. However, a wavelength λ1 equivalent to the first frequency f1 is longer than a wavelength λ2 equivalent to the second frequency f2.

Figure 12:
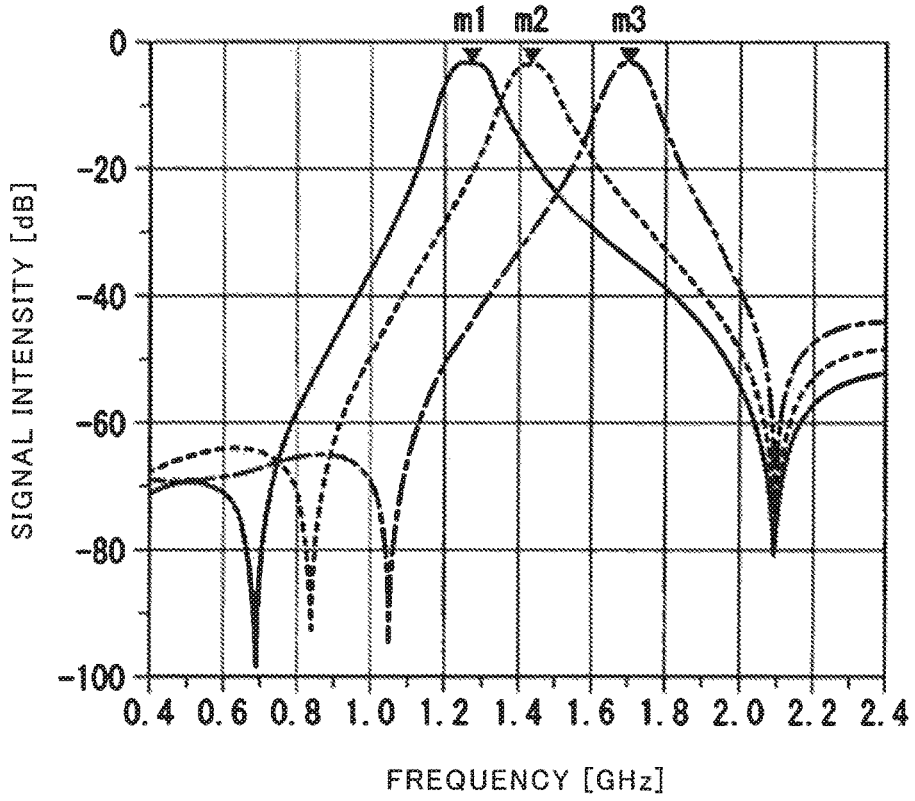
FIG. 12 is a first diagram illustrating a transmission characteristic of a filter circuit in which a signal of a first frequency is caused to pass in the third example embodiment of the present invention.
Figure 13:
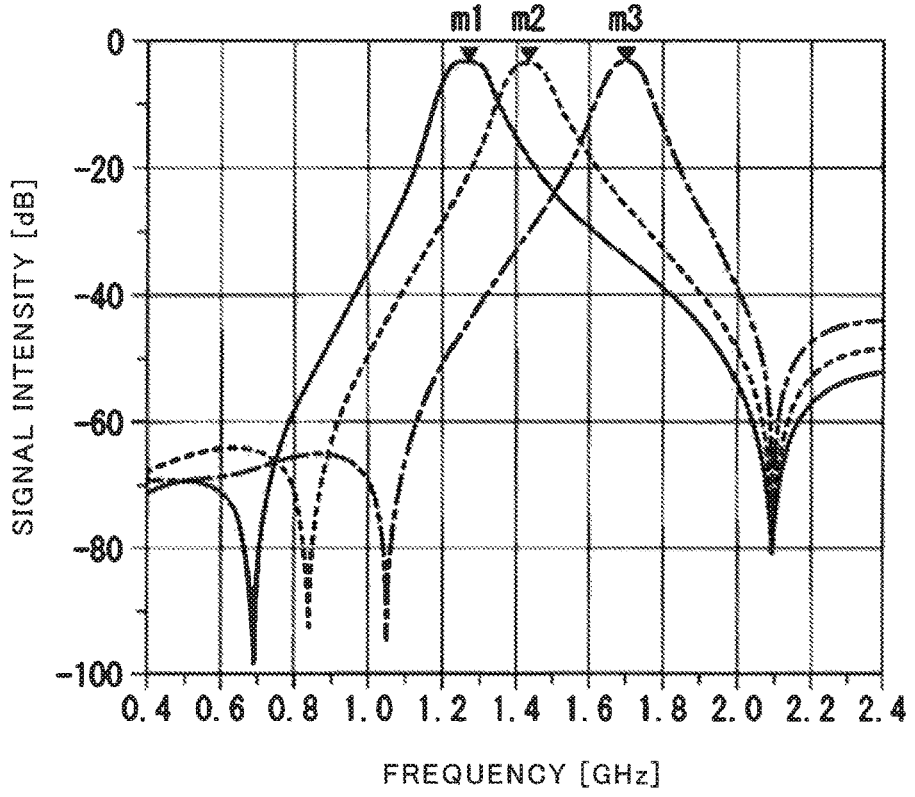
FIG. 13 is a second diagram illustrating a transmission characteristic of a filter circuit in which a signal of a first frequency is caused to pass in the third example embodiment of the present invention.
Figure 14:
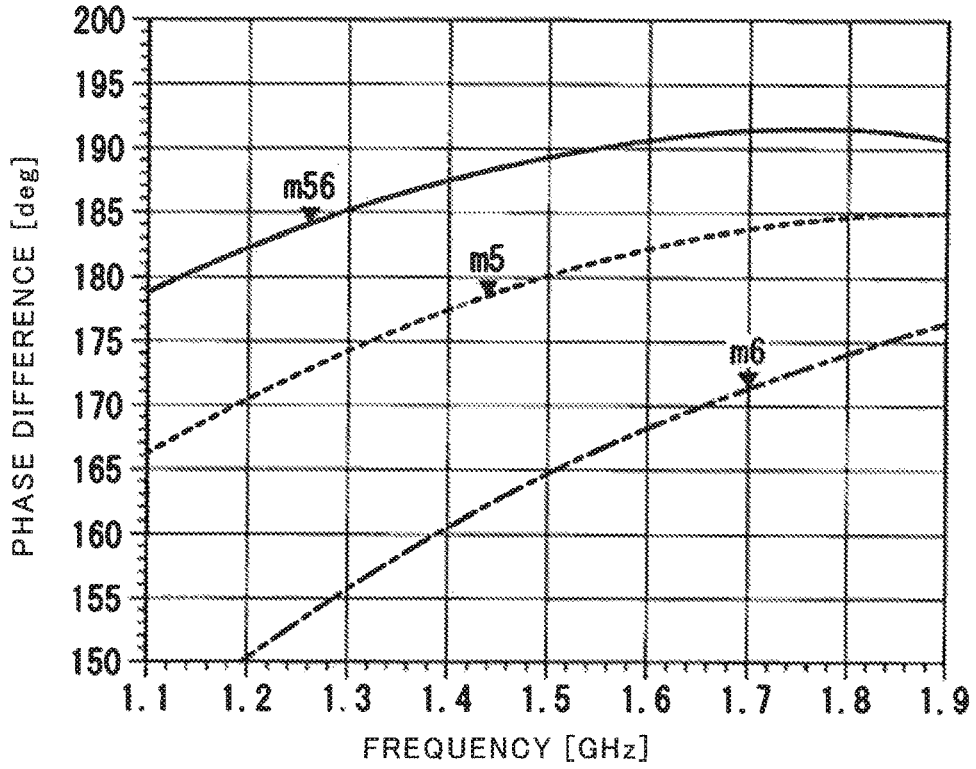
FIG. 14 is a third diagram illustrating a transmission characteristic of a filter circuit in which a signal of a first frequency is caused to pass in the third example embodiment of the present invention.

Transmission characteristics determined from experiments of the filter circuit 10 upon working as a bandpass filter that causes a first frequency f1 to pass are characteristics illustrated in FIGS. 12 to 14.

The transmission characteristics illustrated in FIGS. 12 to 14 are characteristics in a case where a central frequency of a passband is 1.7 GHz (electrostatic capacitance of the first variable capacitor 160*a* and the second variable capacitor 160*b* is 0.5 pF), a central frequency of a passband is 1.44 GHz (electrostatic capacitance of the first variable capacitor 160*a* and the second variable capacitor 160*b* is 2.5 pF), and a central frequency of a passband is 1.26 GHz (electrostatic capacitance of the first variable capacitor 160*a* and the second variable capacitor 160*b* is 5.0 pF).

It is understood that signal intensity in the first output terminal 110*b* illustrated in FIG. 12 and signal intensity in the second output terminal 110*c* illustrated in FIG. 13 are substantially the same and this fact indicates a nearly ideal state.

Further, from FIG. 14, it is understood that a phase difference between a signal in the first output terminal 110*b* of the filter circuit 10 and a signal in the second output terminal 110*c* of the filter circuit 10 is approximately 171 degrees when a frequency of the signal is 1.7 GHz, is approximately 178 degrees when a frequency of the signal is 1.44 GHz, and is approximately 184 degrees when a frequency of the signal is 1.26 GHz, and this fact indicates a nearly ideal state.

As described above, the filter circuit 10 according to the present example embodiment works as a bandpass filter that causes any first frequency f1 (in the example, 1.26 GHz to 1.7 GHz) to pass by changing electrostatic capacitance of the first variable capacitor 160*a* and the second variable capacitor 160*b*.

Next, an operation of the filter circuit 10 upon working as a bandpass filter that causes a signal of a second frequency f2 to pass is described.

The filter circuit 10 works as a bandpass filter that causes a signal of a second frequency f2 to pass when both of the first switch 120*a* and the second switch 120*b* are caused to be in a short-circuited state as illustrated in FIG. 7.

When a signal is applied to the input terminal 110*a*, a direct-current component of the signal is cut by the first capacitor 140*a*. The signal in which the direct-current component is cut propagates in a first sub-transmission line 101. The signal is transmitted, when propagated in the first sub-transmission line 101, to the first sub-coupling unit 131 that is electromagnetically coupled to the first sub-transmission line 101.

Each of the first switch 120*a* and the second switch 120*b* is in a short-circuited state. Therefore, the first main transmission line 130*a* and the second main transmission line

130*b* work as a resonator having an electrical length different from an electrical length in a case where each of the first switch 120*a* and the second switch 120*b* is in an open state.

Figure 15:
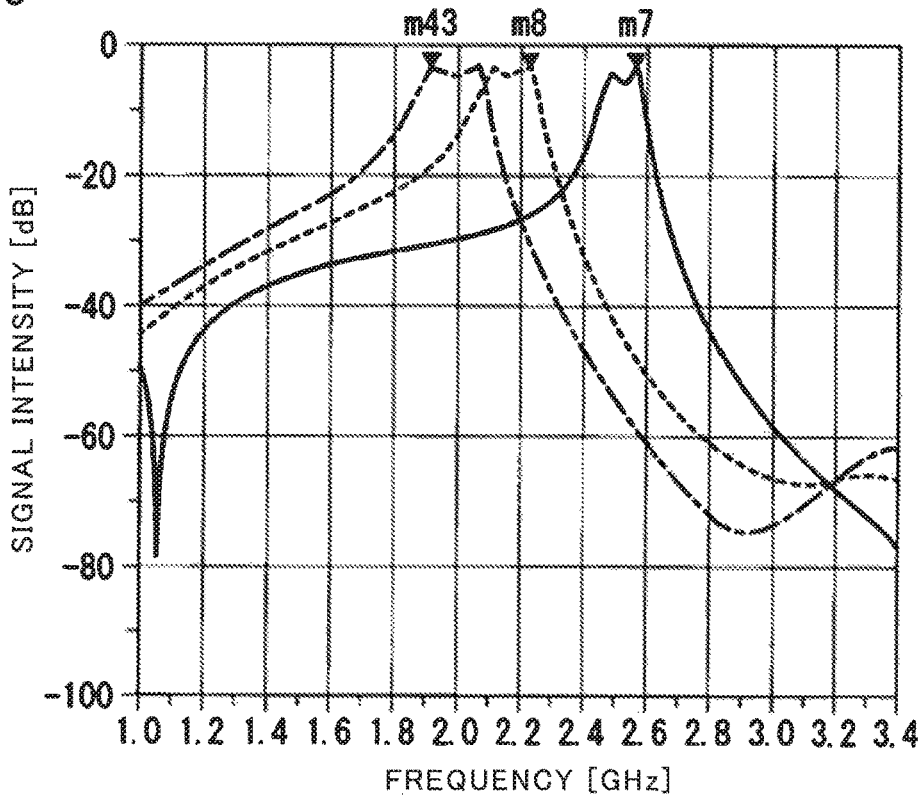
FIG. 15 is a first diagram illustrating a transmission characteristic of a filter circuit in which a signal of a second frequency is caused to pass in the third example embodiment of the present invention.
Figure 16:
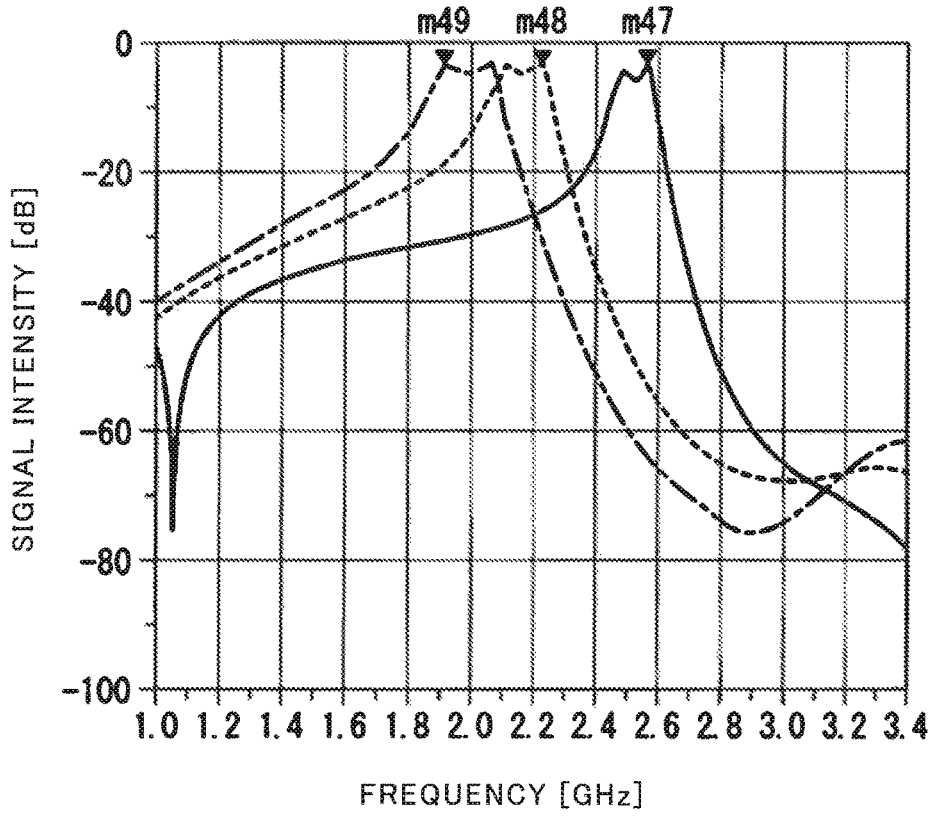
FIG. 16 is a second diagram illustrating a transmission characteristic of a filter circuit in which a signal of a second frequency is caused to pass in the third example embodiment of the present invention.
Figure 17:
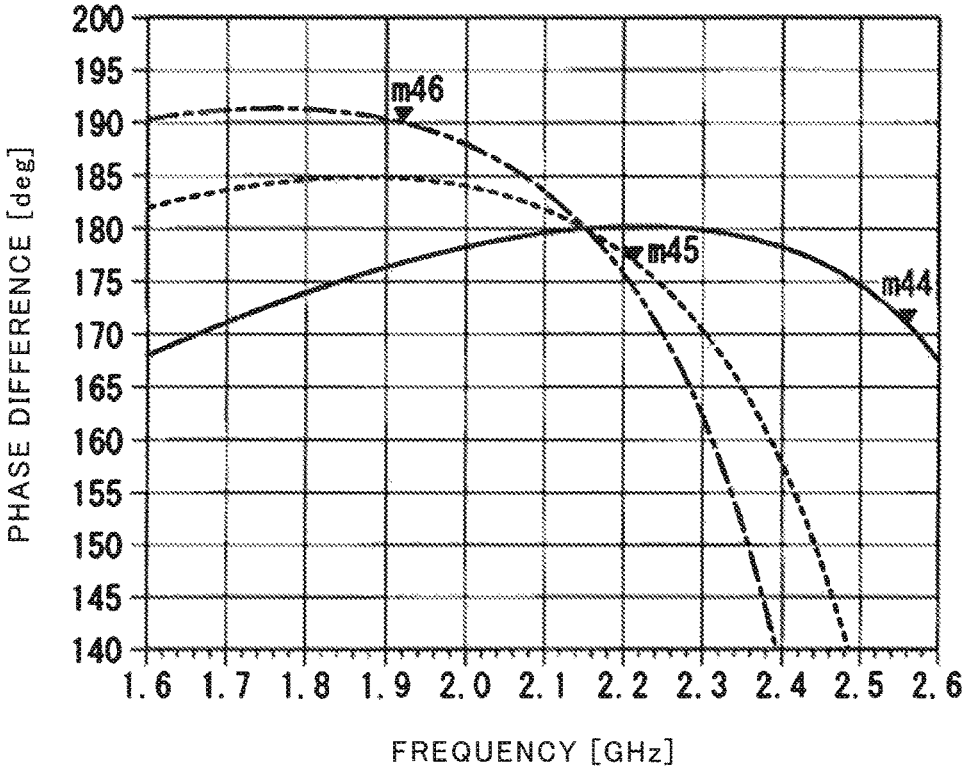
FIG. 17 is a third diagram illustrating a transmission characteristic of a filter circuit in which a signal of a second frequency is caused to pass in the third example embodiment of the present invention.

Transmission characteristics determined from experiments of the filter circuit 10 upon working as a bandpass filter that causes a second frequency f2 to pass are characteristics illustrated in FIGS. 15 to 17.

The transmission characteristics illustrated in FIGS. 15 to 17 are characteristics in a case where a central frequency of a passband is 2.56 GHz (electrostatic capacitance of the first variable capacitor 160*a* and the second variable capacitor 160*b* is 0.5 pF), a central frequency of a passband is 2.2 GHz (electrostatic capacitance of the first variable capacitor 160*a* and the second variable capacitor 160*b* is 2.5 pF), and a central frequency of a passband is 1.91 GHz (electrostatic capacitance of the first variable capacitor 160*a* and the second variable capacitor 160*b* is 5.0 pF).

It is understood that signal intensity in the first output terminal 110*b* illustrated in FIG. 15 and signal intensity in the second output terminal 110*c* illustrated in FIG. 16 are substantially the same and this fact indicates a nearly ideal state.

Further, from FIG. 17, it is understood that a phase difference between a signal in the first output terminal 110*b* of the filter circuit 10 and a signal in the second output terminal 110*c* of the filter circuit 10 is approximately 172 degrees when a frequency of the signal is 2.56 GHz, is approximately 177 degrees when a frequency of the signal is 2.2 GHz, and is approximately 190 degrees when a frequency of the signal is 1.91 GHz, and this fact indicates a nearly ideal state.

As described above, the filter circuit 10 according to the present example embodiment works as a bandpass filter that causes any second frequency f2 (in the example, 1.91 GHz to 2.56 GHz) to pass by changing electrostatic capacitance of the first variable capacitor 160*a* and the second variable capacitor 160*b*.

Processing of the filter circuit 10 according to the third example embodiment of the present invention is described above. The above-described filter circuit 10 includes a first sub-transmission line 101 having an electrical length that is one sixth of a first wavelength λ1 corresponding to a first frequency f1. The filter circuit 10 includes a second transmission line 102 having an electrical length that is one sixth of the first wavelength λ1 and being disposed to be opposed to the first sub-transmission line 101 separately from each other. The filter circuit 10 includes an input terminal 110*a* connected to a first end of two ends in a direction where current in the first sub-transmission line 101 flows.

The first circuit 10 includes a third transmission line 103 having an electrical length that is one sixth of the first wavelength λ1. The filter circuit 10 includes a fourth transmission line 104 having an electrical length that is one sixth of the first wavelength λ1 and being disposed to be opposed to the third transmission line 103 separately from each other.

The filter circuit 10 includes a first output terminal 110*b* connected to a first end of two ends in a direction where current in the fourth transmission line 104 flows. The filter circuit 10 includes a second output terminal 110*c* connected to a second end of the two ends in the direction where current in the fourth transmission line 104 flows.

The filter circuit 10 includes a first open end 107 having a predetermined electrical length and including a first end connected to a first end of the second transmission line 102 opposed to a second end of the two ends in the direction where current in the first sub-transmission line 101 flows and a second end that is open. The filter circuit 10 includes a second open end 108 having a predetermined electrical length and including a first end connected to a first end of the third transmission line 103 opposed to a second end of the two ends in the direction where current in the fourth transmission line 104 flows and a second end that is open.

The filter circuit 10 includes a fifth transmission line 105 including a first end connected to a second end of the second transmission line 102. The filter circuit 10 includes a sixth transmission line 106 including a first end connected to a second end of the third transmission line 103 and being disposed in such a way that at least a part of the sixth transmission line 106 is separately opposed to at least a part of the fifth transmission line 105. The filter circuit 10 includes a first switch 120*a* being disposed between a second end of the fifth transmission line 105 and a ground and causing the second end of the fifth transmission line 105 and the ground to be in a connection state or an open state. The filter circuit 10 includes a second switch 120*b* being disposed between a second end of the sixth transmission line 106 and a ground and causing the second end of the sixth transmission line 106 and the ground to be in a connection state or an open state.

An electrical length of a transmission line including the first open end 107, the second transmission line 102, and the fifth transmission line 105 is three quarters of a second wavelength λ2 corresponding to a second frequency f2 that is higher than the first frequency f1. An electrical length of a transmission line including the second open end 108, the third transmission line 103, and the sixth transmission line 106 is three quarters of the second wavelength λ2.

By doing in such a manner, the filter circuit 10 can avoid radio wave interference by causing only a signal of a desired frequency to pass through a simple configuration and can efficiently use a frequency band by causing signals of largely different frequencies to pass.

Further, at least one of a second end of the first open end 107 or a second end of the second open end 108 is connected to the other end of a capacitor one end of which is connected to a ground. Electrostatic capacitance is variable.

By doing in such a manner, the filter circuit 10 can avoid radio wave interference by causing only a signal of a desired frequency to pass through a simple configuration by changing electrostatic capacitance of a capacitor. In addition thereto, the filter circuit 10 can efficiently use a frequency band by causing signals of largely different frequencies to pass.

According to the filter circuit 10 according to the third example embodiment of the present invention, a passband of the filter circuit 10 may be changed by opening/closing the first switch 120*a* and the second switch 120*b* and changing electrostatic capacitance of the first variable capacitor 160*a* and the second variable capacitor 160*b*.

Further, in the third example embodiment, a first frequency f1 and a second frequency f2 are described as a given frequency. However, a range of a value of electrostatic capacitance of the first variable capacitor 160*a* and the second variable capacitor 160*b* may be widened or various types of parameters such as a line width of a coupling line, a coupling interval, and the like may be adjusted. Thereby, the filter circuit 10 may cause any continuous signals of a plurality of frequencies to pass.

In the third example embodiment of the present invention, the first open end 107 is described as including the first variable capacitor 160*a* and the first sub-coupling unit 131. Further, the second open end 108 is described as including the second variable capacitor 160*b* and the second sub-coupling unit 132. However, neither the first open end 107 nor the second open end 108 is limited thereto. The first open end 107 may include, for example, only the first variable capacitor 160*a*. Further, the second open end 108 may include, for example, only the second variable capacitor 160*b*. Further, each of the first open end 107 and the second open end 108 may include a fixed capacitor instead of a variable capacitor.

A specific configuration of the filter circuit 10 according to the example embodiments of the present invention is not limited to the above-described configurations. A specific configuration of the filter circuit 10 according to the example embodiments of the present invention may be a configuration according to various design modifications and the like.

For example, in the above-described example embodiments, each transmission line has a linearly extending shape but is not limited thereto. Each transmission line according to the example embodiments of the present invention may be, for example, a shape a part of which has a bent portion such as a hairpin shape and the like.

Further, in the above-described example embodiments, the input terminal 110*a* is described as being connected to a first terminal of the first sub-transmission line 101 via the first capacitor 140*a*. Further, the first output terminal 110*b* is described as being connected to a first terminal of the second sub-transmission line 104 via the second capacitor 140*b*. Further, the second output terminal 110*c* is described as being connected to a second terminal of the second sub-transmission line 104 via the third capacitor 140*c*. However, each of the input terminal 110*a*, the first output terminal 110*b*, and the second output terminal 110*c* is not limited thereto.

The input terminal 110*a* may be connected to, for example, a second terminal of the first sub-transmission line 101 via the first capacitor 140*a*. Further, the first output terminal 110*b* may be connected to a second terminal of the second sub-transmission line 104 via the second capacitor 140*b*. Further, the second output terminal 110*c* may be connected to a first terminal of the second sub-transmission line 104 via the third capacitor 140*c*.

Further, for example, in the filter circuit 10, when an influence of a direct-current component of a signal is sufficiently small, the filter circuit 10 is not necessarily include each of the first capacitor 140*a*, the second capacitor 140*b*, and the third capacitor 140*c*.

Further, for example, in the filter circuit 10, when impedance matching is sufficient, the filter circuit 10 is not necessarily include the fourth capacitor 150.

While the example embodiments of the present invention are described, the above-described filter circuit 10 may internally include a computer system. In this case, steps of the above-described processing are stored on a computer-readable recording medium in a format of a program, and the program is read and executed by a computer, whereby the processing is executed. The computer-readable recording medium refers to a magnetic disk, a magneto-optical disk, a compact disc read only memory (CD-ROM), a digital versatile disc read only memory (DVD-ROM), or a semiconductor memory. Further, it is possible that the computer program is delivered to a computer via a communication line and the computer receiving the delivery executes the program.

Further, the program may be a program for realizing a part of the above-described functions. Further, the program may be a so-called a differential file (differential program) which is capable of realizing the above-described functions by being combined with a program already recorded on a computer system.

While several example embodiments of the present invention are described, these example embodiments have been presented as examples and do not limit the scope of the present invention. Further, within a scope that is not departing from the gist of the present invention, various additions, omissions, substitutions, and modifications may be made.

This application claims a priority based on Japanese patent application No. 2016-007911 filed on Jan. 19, 2016, the disclosure of which is incorporated herein in its entirety.

REFERENCE SIGNS LIST

10 Filter circuit
12*a* First sub-coupling line
12*b* Second sub-coupling line
101 First transmission line (first sub-transmission line)
102 Second transmission line
103 Third transmission line
104 Fourth transmission line (second sub-transmission line)
105 Fifth transmission line (first main coupling unit)
105*a* First connection unit
105*b* First coupling unit
106 Sixth transmission line (second main coupling unit)
106*a* Second connection unit
106*b* Second coupling unit
107 First open end
108 Second open end
110*a* Input terminal
110*b* First output terminal
110*c* Second output terminal
120*a* First switch
120*b* Second switch
130*a* First main transmission line
130*b* Second main transmission line
131 First sub-coupling unit
132 Second sub-coupling unit
140*a* First capacitor
140*b* Second capacitor
140*c* Third capacitor
150 Fourth capacitor
160*a* First variable capacitor
160*b* Second variable capacitor

What is claimed is:

1. A filter circuit comprising:

a first transmission line that has an electrical length that is one sixth of a first wavelength corresponding to a first frequency;

a second transmission line that has an electrical length that is one sixth of the first wavelength and is disposed to be opposed to the first transmission line separately from each other;

an input terminal connected to a first end of two ends in a direction to which current in the first transmission line flows;

a third transmission line that has an electrical length that is one sixth of the first wavelength;

a fourth transmission line that has an electrical length that is one sixth of the first wavelength and is disposed to be opposed to the third transmission line separately from each other;

a first output terminal connected to a first end of two ends in a direction to which current in the fourth transmission line flows;

a second output terminal connected to a second end of two ends in a direction to which current in the fourth transmission line flows;

a first open end that has a predetermined electrical length and includes a first end connected to a first end of the second transmission line opposed to a second end of two ends in a direction to which current in the first transmission line flows, and a second end that is open;

a second open end that has a predetermined electrical length and includes a first end connected to a first end of the third transmission line opposed to a second end of two ends in a direction to which current in the fourth transmission line flows, and a second end that is open;

a fifth transmission line that includes a first end connected to a second end of the second transmission line;

a sixth transmission line that includes a first end connected to a second end of the third transmission line and is disposed in such a way that at least a part of the sixth transmission line is separately opposed to at least a part of the fifth transmission line;

a first switch that is disposed between a second terminal of the fifth transmission line and a ground and causes the second terminal of the fifth transmission line and the ground to be in a connection state or an open state; and a second switch that is disposed between a second terminal of the sixth transmission line and the ground and causes the second terminal of the sixth transmission line and the ground to be in a connection state or an open state, wherein an electrical length of a transmission line that includes the first open end, the second transmission line, and the fifth transmission line is three quarters of a second wavelength corresponding to a second frequency that is higher than the first frequency, and an electrical length of a transmission line that includes the second open end, the third transmission line, and the sixth transmission line is three quarters of the second wavelength.

2. The filter circuit according to claim 1, wherein the first wavelength is 1.5 times of the second wavelength.

3. The filter circuit according to claim 1, wherein the first open end and the second open end each have an electrical length that is one quarter of the second wavelength.

4. The filter circuit according to claim 1, wherein at least one of a second end of the first open end and a second end of the second open end is connected to one end of a capacitor of which another end is connected to the ground.

5. The filter circuit according to claim 4, wherein electrostatic capacitance of the capacitor is variable.

6. A frequency switching method comprising:

opening the first switch and the second switch according to claim 1; and short-circuiting the first switch and the second switch.

* * * * *